US007111421B2

(12) United States Patent
Corry et al.

(10) Patent No.: US 7,111,421 B2
(45) Date of Patent: Sep. 26, 2006

(54) SIMULATED LOG BURNING FIREPLACE APPARATUS

(76) Inventors: Arthur A. Corry, 6832 Trail Blvd., Naples, FL (US) 34108; Nigel A. Corry, 1614 Forest Lakes Blvd., Naples, FL (US) 34105

( * ) Notice: Subject to any disclaimer, the term of this patent is extended or adjusted under 35 U.S.C. 154(b) by 0 days.

(21) Appl. No.: 10/371,959

(22) Filed: Feb. 20, 2003

(65) Prior Publication Data

US 2003/0126775 A1 Jul. 10, 2003

Related U.S. Application Data

(63) Continuation-in-part of application No. 09/862,002, filed on May 22, 2001, now abandoned.

(51) Int. Cl.
*G09F 19/00* (2006.01)

(52) U.S. Cl. ..... 40/428; 392/348

(58) Field of Classification Search ..... 40/428; 472/65; 392/348

See application file for complete search history.

(56) References Cited

U.S. PATENT DOCUMENTS

| | | | | | |
|---|---|---|---|---|---|
| 3,395,475 | A * | 8/1968 | Moss | 40/428 |
| 3,603,013 | A * | 9/1971 | Reed et al. | 40/428 |
| 3,742,189 | A * | 6/1973 | Conroy et al. | 392/348 |
| 4,965,707 | A * | 10/1990 | Butterfield | 362/96 |
| 5,099,591 | A * | 3/1992 | Eiklor et al. | 40/428 |
| 6,363,636 | B1 * | 4/2002 | Hess et al. | 40/428 |
| 6,385,881 | B1 * | 5/2002 | Hess | 40/428 |

FOREIGN PATENT DOCUMENTS

| | | | | |
|---|---|---|---|---|
| GB | 2298073 | * | 8/1996 | 40/428 |
| GB | 2302172 | * | 1/1997 | 40/428 |
| GB | 2350420 | * | 11/2000 | 40/428 |
| JP | 9-112922 | * | 5/1997 | 40/428 |
| WO | WO-01/57447 | * | 8/2001 | 40/428 |

* cited by examiner

*Primary Examiner*—Joanne Sibermann

(57) ABSTRACT

The simulated log fireplace apparatus housing forming a fire box having back, bottom, top wall, two side walls, and an open front containing at least one artificial log and simulated flame sheet. A blower directs air on to the flame sheet to simulate real flame movement. A colored light source provides color of real flames. The light source and blower are adjustable from a control panel under a top louver panel. The artificial log may include a translucent base log and ember bed with a light source beneath the translucent log. A window log having an aperture simulate a burning core. A transparent partition has a partially opaque area just above the simulated flame sheet provides the full depth of real fireplace. The apparatus may include electric blower heater, a crackle box, decorative simulated brick panels placed on back and side walls, metal screen, glass doors, vents and louvers.

15 Claims, 2 Drawing Sheets

SIMULATED LOG BURNING FIREPLACE APPARATUS

CROSS REFERENCE TO RELATED APPLICATION

This application is a continuation-in-part of Ser. No. 09/862,002, filed May 22, 2001, now abandoned.

BACKGROUND OF INVENTION

This invention relates to apparatuses that simulate the appearance of a fireplace and more particularly an electric log fireplace that simulates the three dimensional visual effect of flames that is virtually indistinguishable from a real log burning fireplace.

Decorative artificial fireplaces and assemblies to install into existing fireplaces have been manufactured and sold in Canada and major countries in Europe for decades. However, in the United States interest in artificial electric fireplaces has been negligible due largely to the artificial appearance thereof as compared to a real log burning fire or a gas fired artificial log fire.

Presently, many different types of decorative electric log fireplaces assemblies being manufactured and sold worldwide. One of these assemblies has a simulated transparent fiberglass log illuminated with an electric bulb and a spinner inside the log to create a blinking affect. However, there are no simulated flames. A second type uses an opaque transparent plastic or Fresnel screen as a back projection screen when viewed from the front in which a log display is set low and in front of the screen. A third type uses a flat microwave in an attempt to provide a hologram appearance. A fourth type employs a Regency or Victorian fire basket filled with pieces of colored glass that reflect light from an electric light bulb and spinner beneath the pieces of colored glass. Finally, the fifth type uses a log with linear yellow and clear metal strips which resemble flame shapes and a blower to blow the strips in order to simulate the flames.

Unfortunately, these types of electric log fireplaces still result in an artificial fire appearance, particularly when a full size opaque plastic sheen is used as such a screen reduces the depth of a fireplace box to a narrow area. Although attempts have been made by some manufacturers to increase the visual effect of the fireplace depths by relying on reflective mirrors to reflect the logs thereby producing a virtual image of the logs appearing to increase the size of the fireplace box, the result is still a two dimensional flame appearance. Furthermore, a substantial loss of flame brightness results due to refraction of the light through the opaque plastic screens, which increases with increasing viewing angle, similar to the effect of visual experience with back projection televisions.

Thus, a need exists for an artificial log burning fireplace assembly that provides a three dimensional visual flame appearance of a real wood burning fireplace, particularly in terms of brightness, color and random movement of the flames.

SUMMARY OF THE INVENTION

The objects of the present invention are to provide an artificial electric fireplace that:

is virtually undistinguishable from a real fireplace;

has a three dimensional flame appearance;

contains logs having an appearance of a real wood burning log;

emits heat to further increase the reality of a real log burning fire; and has the size and appearance of a conventional fireplace.

The present invention fulfills the above and other objects by providing a simulated log burning fireplace assembly with a housing forming a fire box having a back wall, a bottom wall, a top wall, two side walls, and an open front with at least one artificial log lying on the bottom wall and having at least one simulated flame formed by translucent material, such as silk, cut in the shape of a flame. At least one blower located proximate the bottom wall of the housing directed at an angle toward the at least one flame sheet blows against the flame sheet to simulate the random, floppy movement of a real flame. The housing further contains at least one light source which may be colored, positioned beneath the at least one flame sheet. The at least one artificial log may comprise a translucent base log on an ember bed having a light source beneath it to illuminate the log. The at least one artificial log may further comprise additional logs at least some of said artificial logs having apertures for light from the light sources to be visible from a viewer so as to simulate a burning core of a real wood log. The blower and light sources are adjustably variable in strength and intensity by variable switches located on the control panel which is connected to an electric power sources, such as a household receptacle. The simulated flame sheets can be cut down the sides to form thin pieces to more closely simulate real flames when blown. Preferably, the fireplace has a transparent partition placed in front of the simulated flames which would preferably be transparent above the height of the simulated flames to provide depth and simulate even further the appearance of a real fireplace. To simulate actual wood burning, the apparatus may also contain a battery-operated crackle box which would be placed in the bottom of the housing in a location that is not visible from the front of the apparatus. The back and side walls of the housing may have ceramic inserts to simulate a brick pattern.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
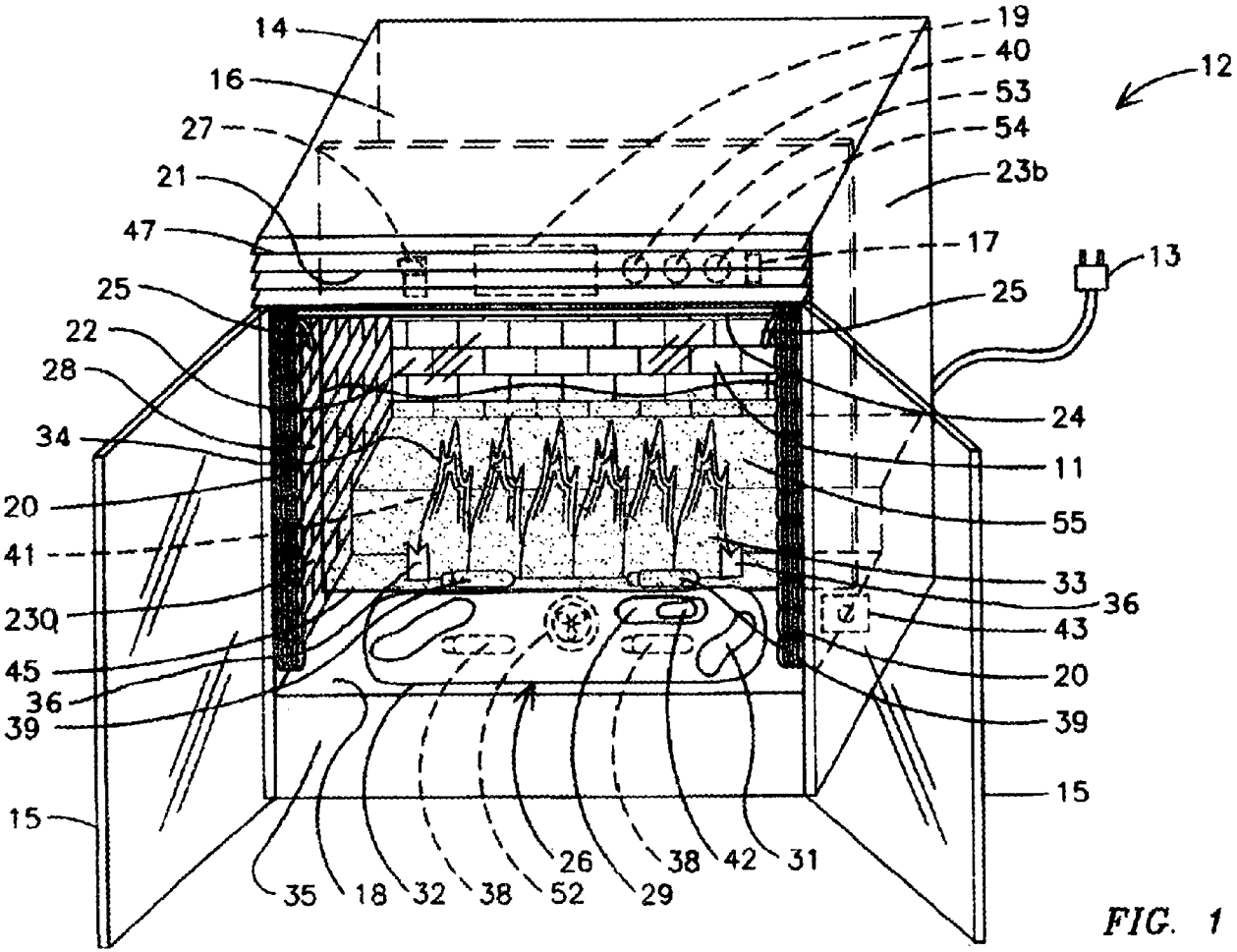
FIG. 1 is a front perspective plan view of the simulated log fireplace assembly of the present invention.

For purposes of describing the preferred embodiment, the terminology used in reference to the numbered components in the drawings is as follows:

| | |
|---|---|
| 11. | Open front |
| 12. | Fireplace assembly |
| 13. | Power |
| 14. | Housing |
| 21. | Control unit |

-continued

| | |
|---|---|
| 22. | Back wall |
| 23a,b | Side walls |
| 24. | Curtain rod |
| 25. | Curtain handles |
| 26. | Base log ember bed |
| 28. | Brick panels |
| 29. | Window log |
| 30. | Brick panels |
| 31. | Wood chippings |
| 32. | Base log |
| 33. | Flame sheet |
| 35. | Stepped platform |
| 37. | Heater |
| 38. | White bulb |
| 39. | Colored bulbs |
| 40. | Flame speed switch |
| 41. | Painted edges of sheet |
| 42. | Aperture in window log |
| 43. | Crackle box |
| 45. | Transparent partition |
| 47. | Drop-down louver panel |
| 48. | Fixed louvers |
| 50. | Front door |
| 51. | Light source (bulbs) for ember bed |
| 52. | Blower |
| 53. | Base log illumination switch |
| 54. | Flame sheet color illumination switch |
| 55. | Obscure area or partition |
| 56. | Other logs |

Figure 2:
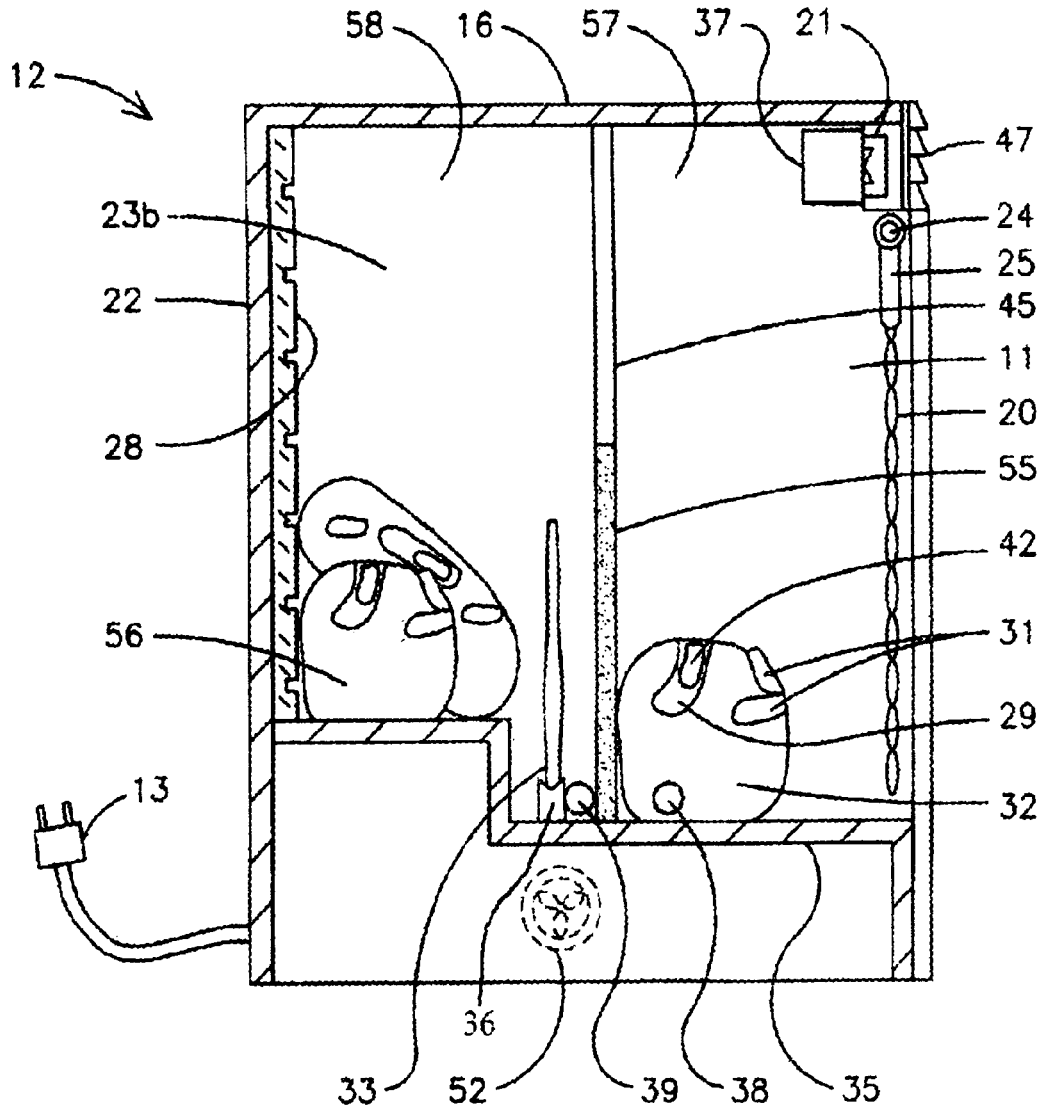
FIG. 2 is a side cutaway view of the simulated log fireplace assembly of the present invention.

The simulated log fireplace assembly 12 of the present invention is illustrated in FIGS. 1–2. The assembly 12 can be connected to a household AC outlet by wire and plug 13. The fireplace assembly 12 includes a housing 14 that defines a fireplace having a top wall 16, a bottom wall or floor 18, two side walls 23*a, b*, a back wall 22, and an open front side 11 having a slidable front curtain 20 with a divided transparent front door 15. The side walls 23*a, b* and back wall 22 are preferably covered by simulated brick inserts or panels 28 normally made of ceramic fiber. The transparent front doors 15 are preferably a two swing-away or bi-fold glass or plastic. The front curtain 20 would preferably be the conventional chain link curtain used for conventional fireplaces having two halves that hang on a rod 24 located near the top of the housing 14. The curtain 20 could be drawn apart from the center by using conventional tear-drop rubber handles 25, thereby permitting access to the inside of the fireplace assembly 12.

A control unit 21 is located behind a drop down louver panel 47 near the top of the front side of the fireplace assembly where it is readily accessible to the user. The control unit 21 may have a main power switch 17, a heating unit 19, with an on/off heater switch 27, an adjustable flame speed switch 40, an adjustable base log illumination switch and an adjustable flame sheet color illumination switch 54. A simulated composite large base log and ember bed 26 is supported by a step platform 35 on the bottom wall 18 of the fireplace assembly 12. The simulate large base log and ember bed 26 is comprised of a translucent thermoplastic composite thin wall made by vacuum or injection molding. The ember bed 26 is further coated to resemble both a burning and non-burning large base log in burning embers. Separate ceramic fiber molded small simulated wood chipping 31 is fitted into location platforms molded in a thermoplastic base log 32 to simulate non-burning wood chips when illuminated by a base log illumination light source.

The light source provided for the thermoplastic base log 32 may comprise two clear or frosted tubular 40 watt bulbs 38 positioned directly beneath the ember bed 26. A rotary control switch 53 on the front control panel 21 controls the brightness of the light sources 38. One or more window logs 29 having an aperture 42 therethrough, allows light from the moving illuminated flame sheets 33 to be viewed, thereby simulating a burning core of a real log. On the step platform 35 behind the base log 32 are two location shoulders 36 to receive at least one simulated flame sheet 33. Positioned directly beneath the at least one simulated flame sheets 33 is a cross-flow blower fan 52 that directs forced air upwards onto the flame sheet 33.

Also positioned beneath the flame sheet 33 is a light source consisting of two 40 watt color-coated tubular bulbs 39 which transmit color light rays upwards and onto the flame sheet 33 which together with movement caused by air from the blower fan 52 yields the appearance and random floppy movement of real flames. The strength of the air blowing onto the flame sheets 33 and 34 from the blower fan 52 is controlled by a flame sheet rotary switch 40 speed control on the front control panel 21. The intensity or brightness of color illumination onto the flame sheet 33 and 34 from the bulbs 39 is controlled by a color brightness switch on the control panel 21.

The flame simulation aspects of the present invention are enhanced by using a single-flame sheet 33 preferably made of white silk and cut into the shape of a flame and being finished with painted edges 41. One or more flame sheets 33 are positioned on the step base platform 35.

To further enhance the appearance of and to provide the depth of a real log burning fireplace, a transparent partition 45 is inserted vertically so as to form front 57 and back 58 sections of the fireplace housing. The partition 45 is slightly obscured in an area 55 just above the height of the flame sheets 33 so as to further simulate real flames. Additional logs 56 may be placed behind the partition 45 and simulated flame sheets 33 to simulate the appearance of a large wood burning fireplace.

Although only a few embodiments of the present invention have been described in detail hereinabove, all improvements and modifications to this invention within the scope or equivalents of the claims are included as part of this invention.

The invention claimed is:

1. A simulated log fireplace apparatus comprising:

a housing having a back wall, a bottom wall, a top wall, two side walls, and an open front;

at least one artificial log lying on the bottom wall of the housing;

at least one simulated flame sheet made of translucent material attached proximate the bottom wall, said at least one simulated flame sheet being cut substantially in a shape of a flame;

at least one blower located proximate a bottom of the at least one simulated flame sheet directed at a upward angle toward the at least one simulated flame sheet in a manner so as to be capable of blowing forced air against the at least one simulated flame sheet to simulate random, floppy movement of real flames;

at least one colored light source being positioned proximate the bottom of the at least one simulated flame sheet to illuminate the at least one simulated flame sheet;

an upper transparent partition is inserted vertically dividing the housing into front and back sections covering the full vertical area and positioned in front of the at least one simulated flame sheet and in back of the at least one artificial log, the partition is slightly obscure in the area in front and just above the at least one simulated flame sheet;

at least one additional artificial log positioned behind the upper transparent partition adjacent the back wall;

a control panel for controlling the operation of the at least one blower, said control panel being connectable to an electrical power source.

2. The simulated log fireplace apparatus of claim 1 wherein the at least one artificial log comprises at least one translucent based log on an ember bed.

3. The simulated log fireplace apparatus of claim 2 wherein the at least one colored light source is adjustable in intensity.

4. The simulated log fireplace apparatus of claim 1 wherein the at least one artificial log comprises at least one artificial log having a translucent open window to simulate a burning core of a real wood log.

5. The simulated log fireplace apparatus of claim 4 wherein the at least one colored light source is adjustable in intensity.

6. The simulated log fireplace apparatus of claim 1 wherein the at least one colored light source is adjustable in intensity.

7. The simulated log fireplace apparatus of claim 1 wherein the at least one colored light source is adjustable in intensity.

8. The simulated log fireplace apparatus of claim 1 further comprising an electric heater assembly located in the housing.

9. The simulated log fireplace apparatus of claim 1 wherein the at least one simulated flame sheet is made of light weight translucent silk.

10. The simulated log fireplace apparatus of claim 1 wherein at least one simulated flame sheet is made of light weight translucent silk.

11. The simulated log fireplace apparatus of claim 1 wherein a stepped shelf with one or more steps form the bottom wall of the housing beneath the at least one artificial log.

12. The simulated log fireplace apparatus of claim 1 wherein the back and two sidewalls are lined with decorative simulated brick panels.

13. The simulated log fireplace apparatus of claim 1 further comprising a pair of chain link curtains with a pair of drop handles, said curtains hanging freely on a single straight sliding rod fixed at the top front of the housing, so that when the curtains are fully drawn and in the open position, access to the housing is allowed.

14. The simulated log fireplace apparatus of claim 13 wherein a glass door is secured to the front of the housing in front of the chain link curtains.

15. The simulated log fireplace apparatus of claim 1 wherein the at least one simulated flame sheet has a thin strip cut down at least one side so as to provide an irregular random, movement when blown, similar to the random movement of a real burning flame.

* * * * *